US005666665A

United States Patent [19]

Morgado

[11] Patent Number: 5,666,665

[45] Date of Patent: Sep. 16, 1997

[54] BABY BIB DRIBBLE ROLL

[76] Inventor: Julie Cooper Morgado, 917 18th Ave. NW., Birmingham, Ala. 35215

[21] Appl. No.: 606,576

[22] Filed: Feb. 26, 1996

[51] Int. Cl.[6] ..... A41B 13/10

[52] U.S. Cl. ..... 2/49.1; 2/49.5

[58] Field of Search ..... 2/49.1, 49.5, 104, 2/49.2, 49.4, 50, 51, 48

[56] References Cited

U.S. PATENT DOCUMENTS

| | | | |
|---|---|---|---|
| 2,552,462 | 5/1951 | Sayrin | 2/49.5 |
| 4,862,518 | 9/1989 | Williams et al. | 2/49.1 |
| 5,483,701 | 1/1996 | Ferreyros | 2/49.1 X |
| 5,490,289 | 2/1996 | Lehrer | 2/49.1 X |

*Primary Examiner*—C. D. Crowder
*Assistant Examiner*—Shirra L. Jenkins

[57] ABSTRACT

This invention is an addition to a flat baby bib. The bib has an attached roll of soft, absorbent fabric, (terrycloth, quilting, etc.), to catch the liquid that so often runs out of a new baby's mouth as he drinks from a bottle. The outside of the roll has Velcro patches that allow positioning on the bib wherever is needed to catch the drips. After the bottle is finished, the roll of wet fabric can be removed from the bib, leaving it dry and wearable longer. The roll of material can be unsnapped for washing ease.

1 Claim, 2 Drawing Sheets

BABY BIB DRIBBLE ROLL

BACKGROUND OF THE INVENTION

This invention is concerned with making baby bibs more absorbent. Specifically, it is an apparatus worn on top of a baby's bib during bottle-feeding.

Many newborn babies have problems sucking from a bottle, and as a result, much of their formula runs down their chins and necks. Regular bibs that lie flat against their clothing become saturated quickly, and lose their ability to keep the baby dry. This bib has an extra roll that can be positioned under the baby's chin to catch most of the liquid before it hits the bib, and can be removed from the bib after feeding, in case the bib is still required.

Heretofore, bibs have had removable and/or disposable shields such as British Pat. Nos. 749,066 and 921,940, and U.S. Pat. Nos. 3,286,279 and 3,329,969. However, these were all flat additions that wouldn't absorb as much as a roll of absorbent material would.

SUMMARY OF THE INVENTION

The object of this invention is to provide a neat and easy way to keep a baby drier during bottle-feeding. Another object is to keep the baby's bib and clothes drier, so numerous clothing changes will not be necessary.

DESCRIPTION OF THE PREFERRED EMBODIMENT

Figure 1:
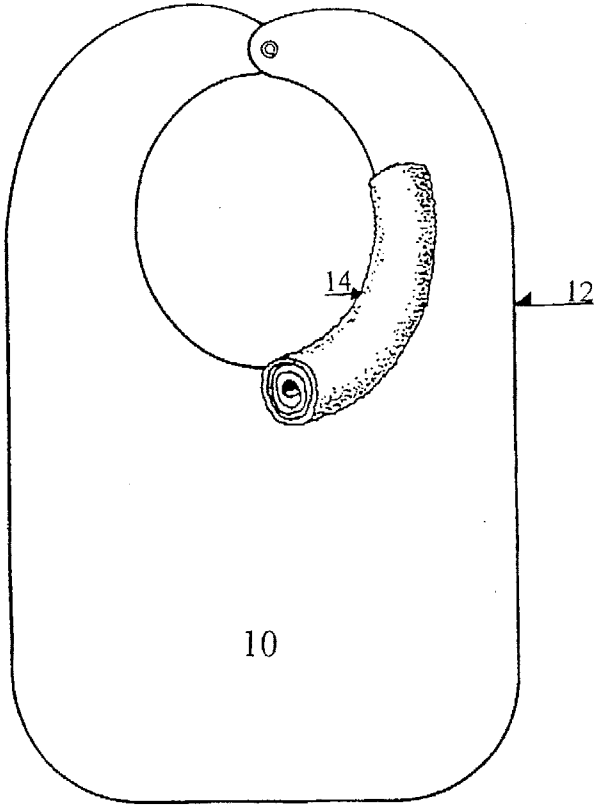
FIG. 1 is a perspective view of this baby bib.
Figure 2:
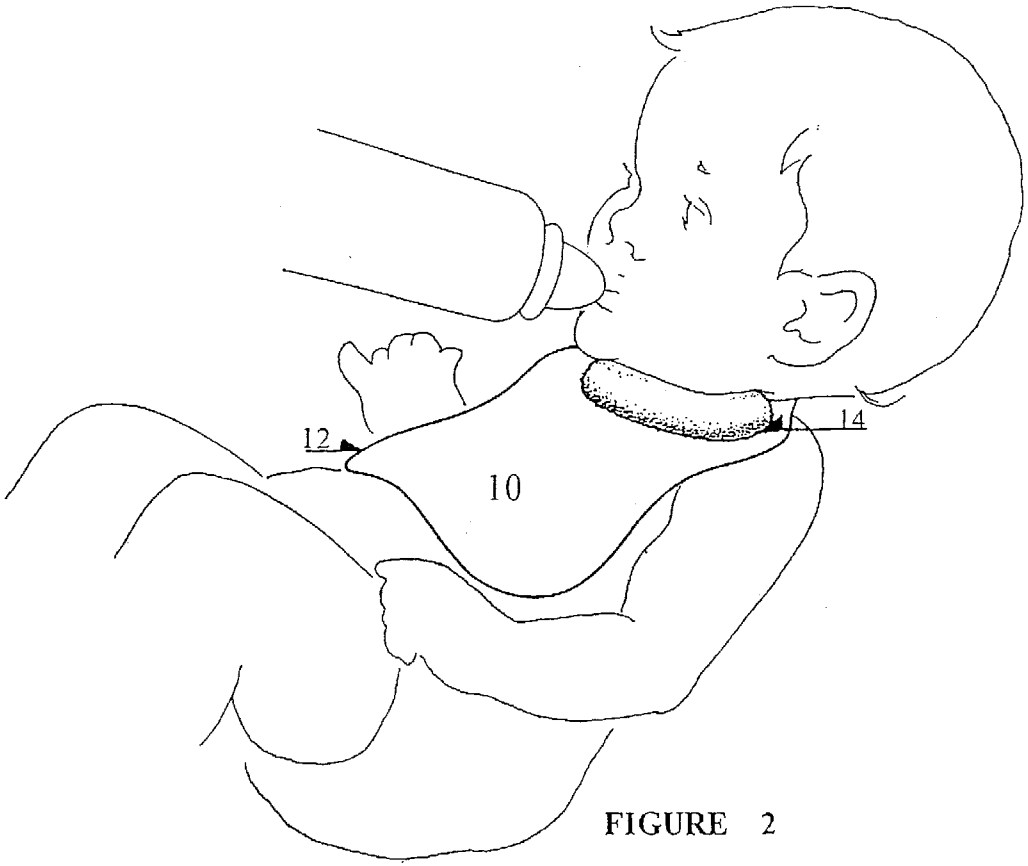
FIG. 2 is a side view of this invention as worn by a baby.
Figure 3:
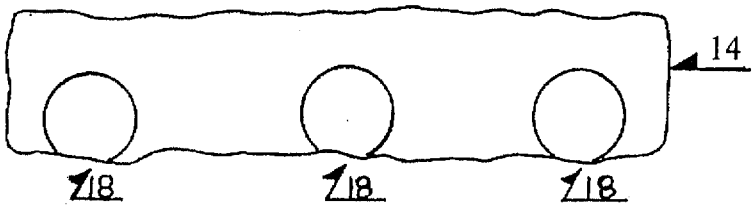
FIG. 3 is a view of the roll.
Figure 4:
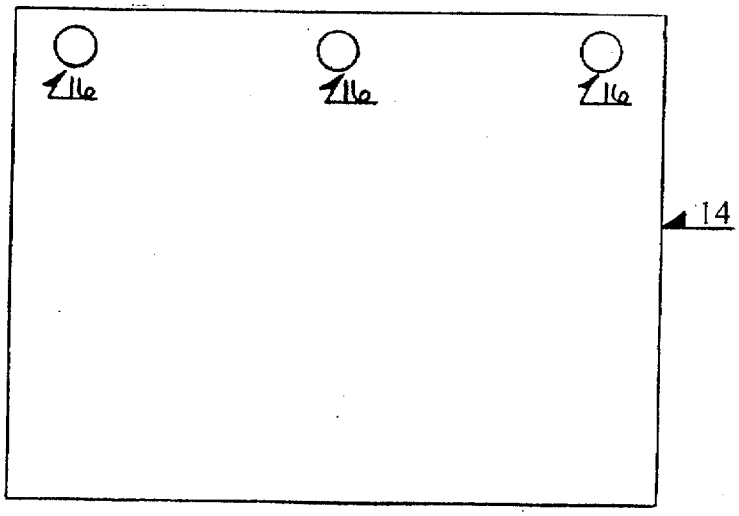
FIG. 4 is a front view of the roll, laid flat.
Figure 5:
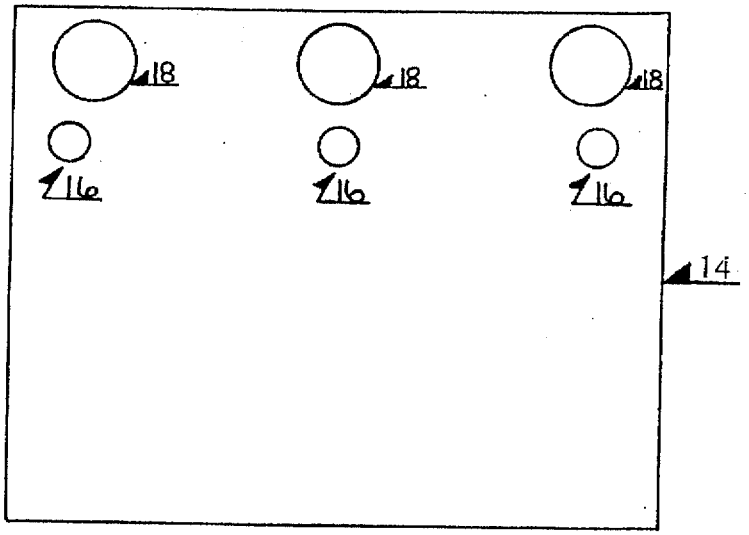
FIG. 5 is a back view of the roll, laid flat.

Referring now to the drawings, the present invention will be designated as 10. Apparatus 10 comprises a flat bib 12 made of absorbent material. Attached to 12 is a square 14 made of soft absorbent material, secured into a roll by 3 sets of snaps 16. The roll 14 is held in place by hook and loop type fasteners such as sold under the trademark Velcro patches 18.

What is claimed is:

1. An apparatus for keeping baby clothes drier during bottle-feeding, comprising:

a flat absorbent bib;

a square of absorbent material, that will be rolled up and snapped together, forming a roll;

3 sets of snaps attached to the absorbent square to secure it into a roll;

3 hook and loop fastener patches attached to the roll for securing the roll to the bib.

* * * * *